US007300443B2

(12) United States Patent
Lau et al.

(10) Patent No.: US 7,300,443 B2
(45) Date of Patent: Nov. 27, 2007

(54) EPILATING APPLIANCE

(75) Inventors: Tung Yan Lau, Fotan (HK); Ming Kuen Leung, Fotan (HK)

(73) Assignee: Specialife Industries Ltd., Hong Kong (HK)

( * ) Notice: Subject to any disclaimer, the term of this patent is extended or adjusted under 35 U.S.C. 154(b) by 715 days.

(21) Appl. No.: 10/705,512

(22) Filed: Nov. 10, 2003

(65) Prior Publication Data

US 2005/0101971 A1 May 12, 2005

(51) Int. Cl.
*A61B 17/50* (2006.01)

(52) U.S. Cl. ..... 606/133

(58) Field of Classification Search ..... 606/131, 606/133; 20/43.4, 43.7–43.92
See application file for complete search history.

(56) References Cited

U.S. PATENT DOCUMENTS

| | | | | |
|---|---|---|---|---|
| 5,108,410 | A | 4/1992 | Iwasaki et al. | 606/133 |
| 5,171,315 | A | 12/1992 | Cabrero | 606/131 |
| 5,494,485 | A * | 2/1996 | Gabion et al. | 606/131 |
| 5,857,903 | A | 1/1999 | Ramspeck et al. | 452/82 |
| 6,045,559 | A * | 4/2000 | Sueyoshi et al. | 606/133 |
| 6,322,569 | B1 | 11/2001 | Sueyoshi et al. | 606/133 |
| 2001/0051808 | A1 | 12/2001 | Dolev | 606/133 |
| 2002/0052611 | A1 | 5/2002 | Inoue et al. | 606/133 |

FOREIGN PATENT DOCUMENTS

| | | | |
|---|---|---|---|
| EP | 0 463 936 | A1 | 1/1992 |
| JP | 04005908 | A2 | 1/1992 |
| JP | 07289349 | A2 | 7/1995 |
| JP | 07289351 | A2 | 7/1995 |
| JP | 10211015 | A2 | 8/1998 |
| JP | 11009333 | | 1/1999 |
| JP | 2000-201725 | | 7/2000 |
| JP | 2001061540 | A2 | 3/2001 |
| WO | WO93/04607 | | 3/1993 |

* cited by examiner

*Primary Examiner*—(Jackie) Tan-Uyen Ho
*Assistant Examiner*—Elizabeth Houston
(74) *Attorney, Agent, or Firm*—Ostrolenk, Faber, Gerb & Soffen, LLP

(57) ABSTRACT

A cylindrical rotor for an epilating device of a kind which includes a support body containing an electrical motor which in use provides a rotational drive to the cylindrical rotor. The cylindrical rotor includes a rotor body, a shaft extending through the rotor body about which the rotor body can rotate. At least one array of radially extending blade pairs is positioned to present mutually interacting pinching edges of each the blade pair at the circumference of the cylindrical rotor. Each blade pair includes a rotor body stationary blade and a movable blade. Each of the movable blades of the array is mounted on a shuttle carried by the rotor body which is in a cammed disposition with the shaft. The cammed disposition is of a kind with cooperative surfaces of the shaft and the shuttle which upon the relative rotation of the shaft with the rotor body and the shuttle carried with the rotor body, moves the shuttle in an oscillating manner. Such repeated motion brings each blade pair into and subsequently out of mutual engagement at least at the circumference of the cylindrical rotor to entrap and subsequently release hairs there between.

27 Claims, 7 Drawing Sheets

EPILATING APPLIANCE

FIELD OF INVENTION

The present invention relates to an epilating appliance useful for the use by a person to remove body hair.

BACKGROUND

Epilating devises are most commonly used by people to remove unwanted body hair such as underarm hair and leg hairs. Such devices and as for example described in U.S. Pat. No. 5,857,903 describes an epilating appliance where a plurality of blade pairs are provided. Actuation of the movement of the blade pairs whilst occurring as a result of a single power source being an electric motor, is achieved by separate actuation elements. Accordingly the construction of the cylindrical rotor of U.S. Pat. No. 5,857,903 is relatively complex. In U.S. Pat. No. 5,857,903 the blades of each pair which allows for the hairs of a person to become trapped between them, move in a pivoting manner relative to each other.

In U.S. Pat. No. 5,171,315 there is described an epilating appliance where blade pairs are positioned adjacent each other to move relative to each other and upon contacting each other will clamp hairs between the matting surfaces of the blades. However a blade of each pair is moved relative to each other by being engaged within its own independent slot of a relatively rotational shaft. Accordingly it becomes expensive to manufacture the device of U.S. Pat. No. 5,171,315 since a plurality of blades are position on the single shaft and wherein the shaft is hence required to be cut with slots within which a blade of each pair is positioned.

It is accordingly an object of the present invention to provide an epilating appliance or components therefor which are of a less complex construction than of the mentioned prior art or to at least provide the public with a useful choice.

BRIEF DESCRIPTION OF THE INVENTION

Accordingly in a first aspect the present inventions consists in a cylindrical rotor for an epilating device of a kind which includes a support body containing and electrical motor which in use provides a rotational drive to said cylindrical rotor, said cylindrical rotor including a rotor body a shaft extending through said rotor body and defining an axis of rotation about which said rotor body can rotate at least one array of radially extending blade pairs positioned to present mutually interacting pinching edges of each said blade pair at the circumference of the cylindrical rotor, each blade pair including a rotor body stationary blade and a blade movable relative to said stationary blade wherein each said movable blades of said at least one array is mounted on a shuttle carried by said rotor body and in a cammed disposition with said shaft, said cammed disposition being of a kind wherein cooperative surfaces of said shaft and said shuttle, upon the relative rotation of said shaft with said rotor body and said shuttle carried with said rotor body, moves said shuttle in an oscillating manner in the directions parallel to the axis of rotation of said rotor body, in a manner to repeatedly bring each blade pair into and subsequently out of mutual engagement at least at the circumference of said cylindrical rotor to entrap and subsequently release hairs there between.

Preferably said blades of each blade pair are non parallel to each other in a manner to place the pinching edges of the blades of each blade pair at said circumference more proximate to each other.

Preferably said blades of each blade pair include planar facing regions extending radially inwardly from said pinching edges.

Preferably said pinching edges are annularly extending edges with a radius substantially similar to the cylindrical rotor.

Preferably for each blade pair, said pinching edges are proximate more to each other than the planar facing regions in consequence of said blades at least at said planar facing regions being inclined to each other.

Preferably one of said movable and stationary blades of each blade pair are inclined to the radial plane of said cylindrical rotor, the other of each blade pair being parallel to the radial plane of said cylindrical rotor.

Preferably the planar facing region of one of said movable and stationary blades of each blade pair are inclined to the radial plane of said cylindrical rotor, the planar facing region of the other of each blade pair being parallel to the radial plane of said cylindrical rotor.

Preferably said blades are made from a resiliently flexible sheet metal, wherein the blades of each pair, when in mutual engagement with each other are in pinching edge to pinching edge contact and in at least part planar facing region to planar facing region contact.

Preferably each said blade movable is positioned relative its respective stationary blade to upon the rotation of said rotor body relative to said shaft, move into and subsequently out of relative engagement with each other, at least at the circumference of said cylindrical rotor.

Preferably said array includes at least two blade pairs.

Preferably said array includes at least three blade pairs.

Preferably said array includes at five blade pairs.

Preferably at least two arrays of blade pairs are provided each array separated from the adjacent array and equi-spaced from each other at least on the circumference of said cylindrical rotor.

Preferably three arrays of blade pairs are provided said arrays equi-spaced from each other on the circumference of said cylindrical rotor.

Preferably said rotor body defines a cavity within which said shuttle is engaged and captured and in a manner to allow it so oscillate in the axial direction relative to the rotor body yet remain stationary in said rotational direction relative to said rotor body.

Preferably said cavity includes at least one opening to the perimeter of said rotor body at which said pinching edges of said blade pairs of an array of blades is disposed.

Preferably said rotor body includes a perimeter surface intermediate of said opening(s) said perimeter surface in part defining the cylindrical perimeter of said cylindrical rotor.

Preferably said perimeter surface intermediate of said opening(s) includes annularly extending grooves.

Preferably said perimeter surface intermediate of said opening(s) includes annularly extending grooves, axially spaced from each other and annularly aligned with each of said pair of blades of said array.

Preferably said perimeter surface intermediate of said opening(s) includes annularly extending grooves, axially spaced from each other and annularly aligned with the space between each of said pair of blades when in said non engaged condition, in order to encourage the alignment of hair with which said perimeter surface is in contact with to align for capturing between a blade pair.

Preferably the plurality of said stationary blades of a first array are in annular alignment with the corresponding blades of the other array(s) of blades.

Preferably a said shuttle for each array is provided to move independent of said other shuttles.

Preferably said shuttle includes a cam follower upstand projecting for engagement with a cam surface of said shaft to positively control the positioning of said shuttle for its reciprocating movement relative to said rotor body.

Preferably said cam surface is an annular slot of said shaft and within which said upstand is snugly located.

Preferably said shuttle includes at least two axially spaced upstands, each located within a respective annular slot of said shaft.

Preferably a said camming relationship between said shuttle and said shaft moves said shuttle from a predominant axial position to an intermittent axial position, said predominant axial position corresponding to placing of each blade pair in a non engaged condition and the intermittent axial position corresponding to an engaged condition.

Preferably said shaft extends longitudinally from at least one end of said rotor and includes a means to capture it with a said support body to lock it from rotating with said support body.

In a second aspect the present invention consists in an epilating device comprising a housing containing a motor which rotationally drives a cylindrical rotor mounted to said housing, said cylindrical rotor partly exposing part of its perimeter through an opening of said housing, said cylindrical rotor further including i. a rotor body, and ii. a shaft extending through said rotor body and defining an axis of rotation about which said rotor body can rotate, said shaft remaining stationary to said housing, and iii. at least one array of radially extending blade pairs positioned to present mutually interacting pinching edges of each said blade pair at the circumference of the cylindrical rotor, each blade pair including a rotor body stationary blade and a blade movable relative to said stationary blade wherein each said movable blades of said at least one array is mounted on a shuttle carried by said rotor body and in a cammed disposition with said shaft, said cammed disposition being of a kind wherein cooperative surfaces of said shaft and said shuttle, upon the relative rotation of said rotor body and said shuttle carried with said rotor body about said shaft, moves said shuttle in an oscillating manner in the directions parallel to the axis of rotation of said rotor body, in a manner to repeatedly bring each blade pair into and subsequently out of mutual engagement at least at the circumference of said cylindrical rotor to entrap and subsequently release hairs there between said movement between said blade pairs coincident with the passing of said blade pairs through said opening of said housing.

Preferably said rotor body is mounted to said housing by said shaft.

Preferably said blades of each blade pair are non parallel to each other in a manner to place the pinching edges of the blades of each blade pair at said circumference more proximate to each other.

Preferably said blades of each blade pair include planar facing regions extending radially inwardly from said pinching edges.

Preferably said pinching edges are annularly extending edges with a radius substantially similar to the cylindrical rotor.

Preferably for each blade pair, said pinching edges are proximate more to each other than the planar facing regions in consequence of said blades at least at said planar facing regions being inclined to each other.

Preferably one of said movable and stationary blades of each blade pair are inclined to the radial plane of said cylindrical rotor, the other of each blade pair being parallel to the radial plane of said cylindrical rotor.

Preferably the planar facing region of one of said movable and stationary blades of each blade pair are inclined to the radial plane of said cylindrical rotor, the planar facing region of the other of each blade pair being parallel to the radial plane of said cylindrical rotor.

Preferably said blades are made from a resiliently flexible sheet metal, wherein the blades of each pair, when in mutual engagement with each other are in pinching edge to pinching edge contact and in at least part planar facing region to planar facing region contact.

Preferably each said blade movable is positioned relative its respective stationary blade to upon the rotation of said rotor body relative to said shaft, move into and subsequently out of relative engagement with each other, at least at the circumference of said cylindrical rotor.

Preferably said array includes at least two blade pairs.

Preferably said array includes at least three blade pairs.

Preferably said array includes at five blade pairs.

Preferably at least two arrays of blade pairs are provided each array separated from the adjacent array and equi-spaced from each other at least on the circumference of said cylindrical rotor.

Preferably three arrays of blade pairs are provided said arrays equi-spaced from each other on the circumference of said cylindrical rotor.

Preferably said rotor body defines a cavity within which said shuttle is engaged and captured and in a manner to allow it so oscillate in the axial direction relative to the rotor body yet remain stationary in said rotational direction relative to said rotor body.

Preferably said cavity includes at least one opening to the perimeter of said rotor body at which said pinching edges of said blade pairs of an array of blades is disposed.

Preferably said rotor body includes a perimeter surface intermediate of said opening(s) said perimeter surface in part defining the cylindrical perimeter of said cylindrical rotor.

Preferably said perimeter surface intermediate of said opening(s) includes annularly extending grooves.

Preferably said perimeter surface intermediate of said opening(s) includes annularly extending grooves, axially spaced from each other and annularly aligned with each of said pair of blades of said array.

Preferably said perimeter surface intermediate of said opening(s) includes annularly extending grooves, axially spaced from each other and annularly aligned with the space between each of said pair of blades when in said non engaged condition, in order to encourage the alignment of hair with which said perimeter surface is in contact with to align for capturing between a blade pair.

Preferably the plurality of said stationary blades of a first array are in annular alignment with the corresponding blades of the other array(s) of blades.

Preferably a said shuttle for each array is provided to move independent of said other shuttles.

Preferably said shuttle includes a cam follower upstand projecting for engagement with a cam surface of said shaft to positively control the positioning of said shuttle for its reciprocating movement relative to said rotor body.

Preferably said cam surface is an annular slot of said shaft and within which said upstand is snugly located.

Preferably said shuttle includes at least two axially spaced upstands, each located within a respective annular slot of said shaft.

Preferably a said camming relationship between said shuttle and said shaft moves said shuttle from a predominant axial position to an intermittent axial position, said predominant axial position corresponding to placing of each blade pair in a non engaged condition and the intermittent axial position corresponding to an engaged condition.

Preferably said shaft extends longitudinally from at least one end of said rotor and includes a means to capture it with a said support body to lock it from rotating with said housing.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

FIG. 5B is yet a further alternative assembly to that as shown in FIGS. 4B and C and that the manner in which the movable blades are engaged with the shuttle member is different, FIG. 5C is an assembled view of FIG. 5B.

DETAILED DESCRIPTION OF THE INVENTION

Figure 1:
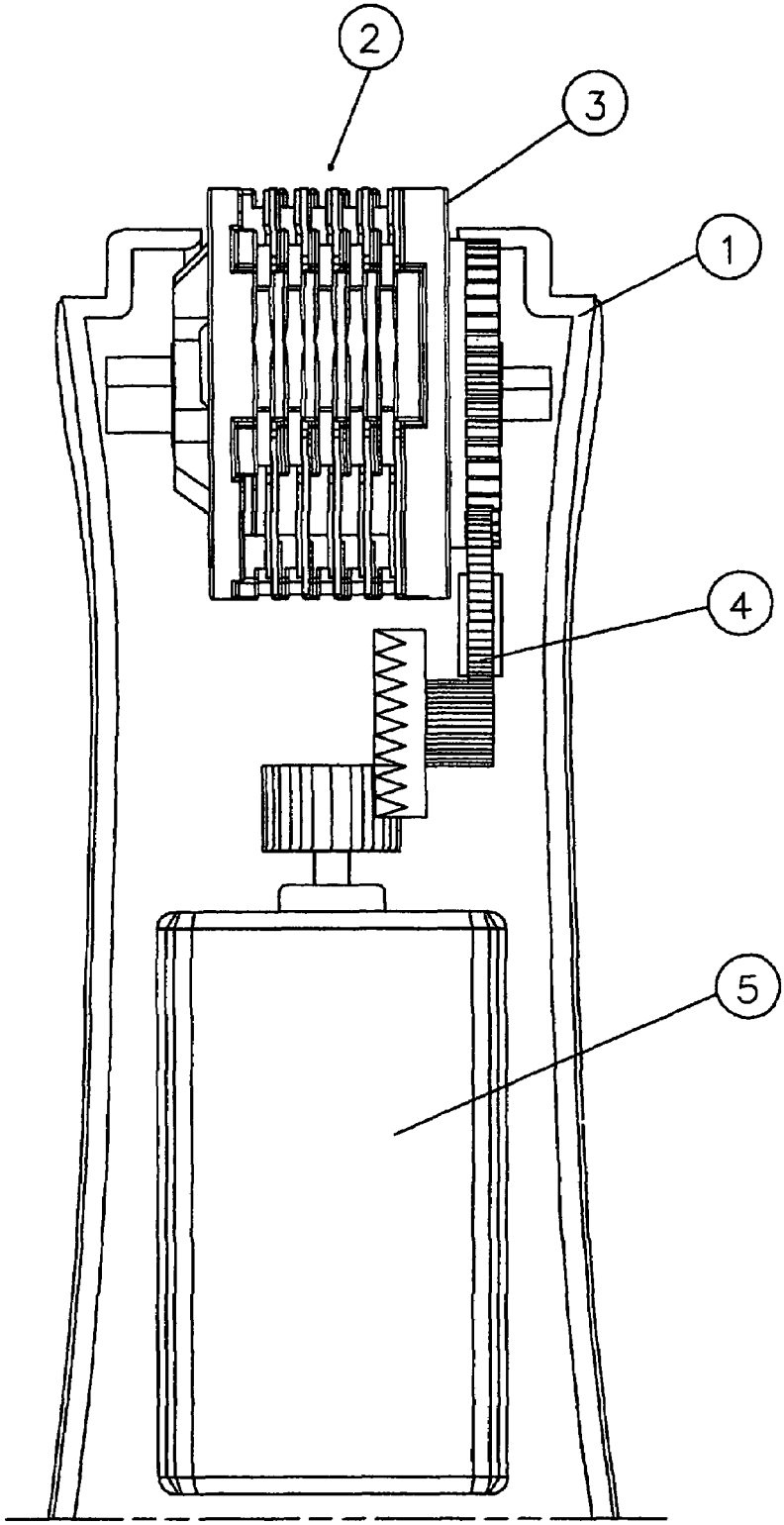
FIG. 1 is a schematic view of an epilating appliance showing the functional components.

With reference to FIG. 1 there is shown an epilating appliance which in general consists of a housing 1 which contains a motor 5 such as an electric motor, normally a battery to power the motor or a connection to a mains power supply and which also includes a cylindrical rotor assembly which upon being driven by the motor 5, operates to provide an epilating or plucking like action. The housing is of a shape to allow it to be ergonomically grasped by the hand of a user. The cylindrical rotor assembly 3 is supported by the housing 1 in a manner to allow it to rotate about its rotational axis. The cylindrical rotor assembly 3 is presented in part through an opening 2 of the housing 1 to present a plucking zone at the cylindrical perimeter of the rotor in a manner to allow such to make contact with the skin of a user. The opening 2 is preferably at an end of the housing 1. Further, in general and with reference to FIG. 1, appropriate gearing for the transmission of the rotary movement from the motor 5 to the cylindrical rotor assembly 3 are also incorporated in the housing 1. In addition a switch and appropriate electronics (not shown) will also be incorporated with the housing 1.

The opening 2 may be of a size sufficient to allow for only a small part of the perimeter (at the plucking zone), of the cylindrical rotor assembly 3 is to be exposed. Such a plucking zone is provided on the cylindrical surface of the cylindrical rotor assembly 3 and to which reference will hereinafter be made in more detail.

The motor 5 may be positioned to provide direct drive to the cylindrical rotor assembly or via gearing 4 as for example shown in the preferred form in FIG. 1.

Figure 2:
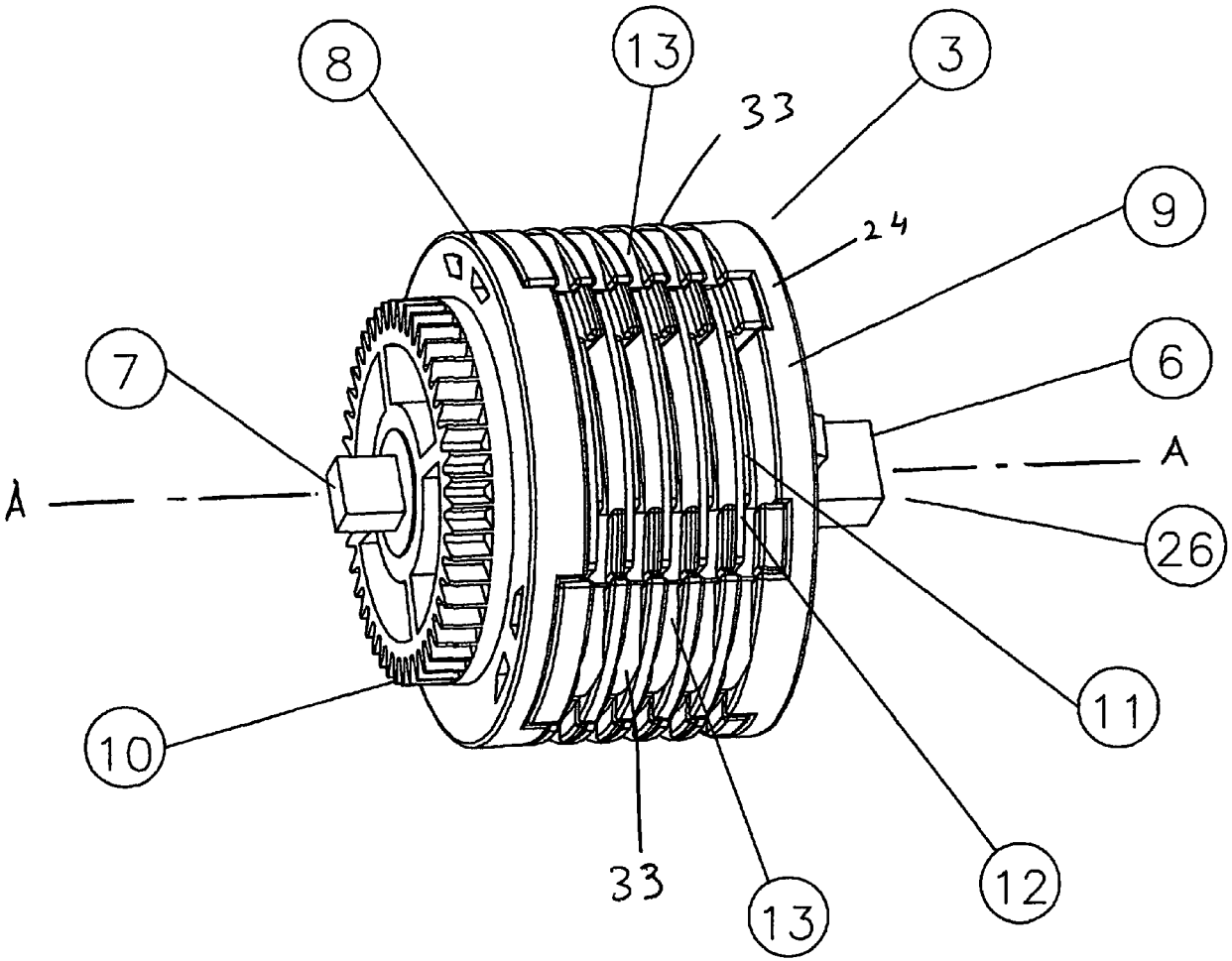
FIG. 2 is a perspective view of the rotary mechanism showing it in the full assembled condition.
Figures 6A, 6B, 6C:
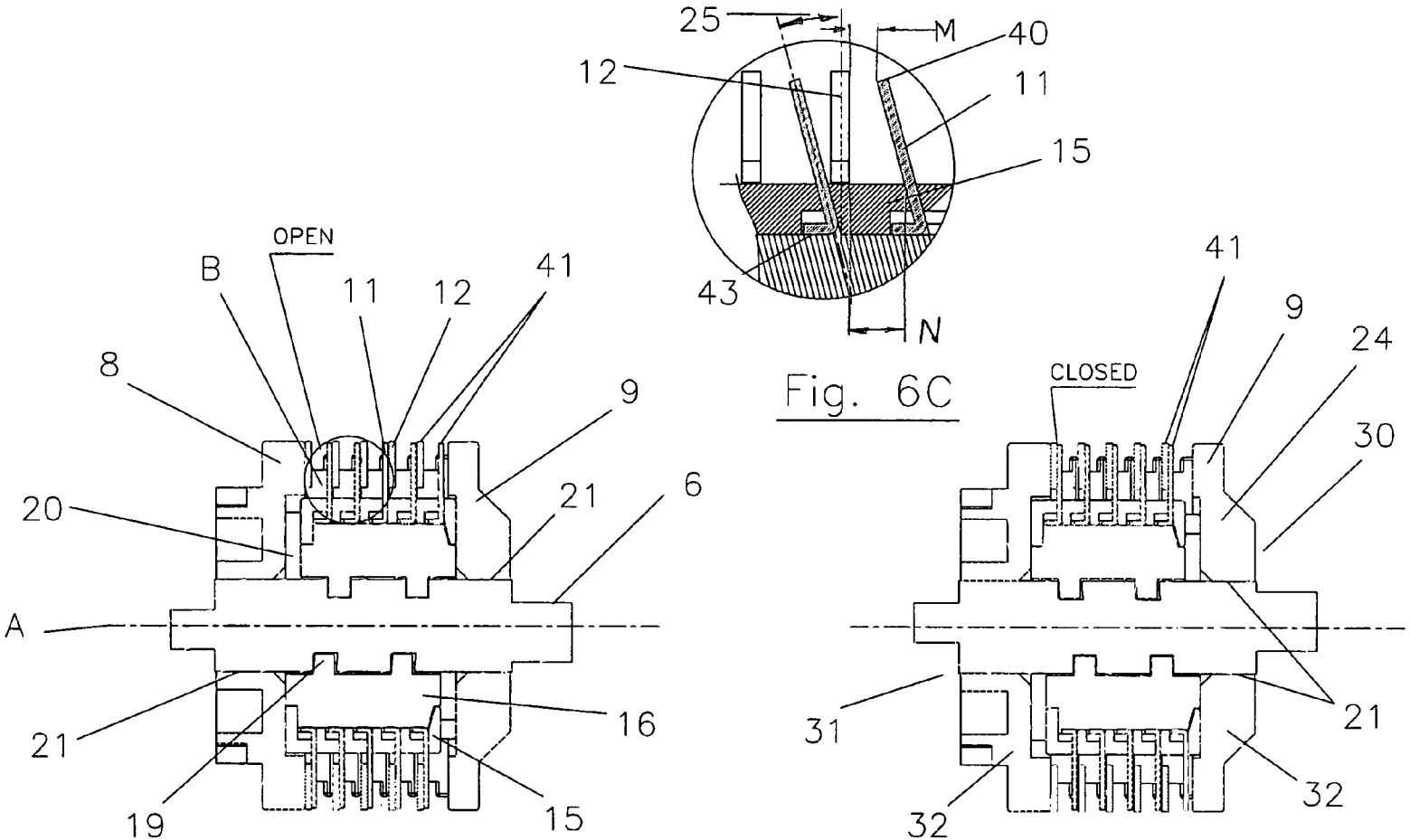
FIG. 6A is a longitudinal sectional view of the rotary mechanism of FIG. 2.
FIG. 6B is a longitudinal sectional view of the rotary mechanism as shown in FIG. 6A but wherein the blade pairs are in a closed condition.
FIG. 6C is a close up view of region B as shown in FIG. 6A.

With reference to FIG. 2, the cylindrical rotor assembly 3 is shown in a perspective view. The cylindrical rotor assembly 3 has, in use, an axis of rotation AA. The cylindrical rotor assembly 3 includes a cylindrical perimeter 8 the centroid of which is coaxial with the axis AA of the cylindrical rotor assembly 3. The cylindrical rotor assembly 3 includes a rotor body 9. The rotor body 9 may itself be an assembly of various components. However the rotor body 9 may generally be defined as a unitary assembly since all of the components of the rotor body 9 are coupled together to rotate about the rotational axis AA and about a shaft 26 which extends through or into the rotor body 9, which extends coaxial with the axis AA. The rotor body 9 is supported dependent from the shaft 26 in a manner to be relatively rotatable thereto. Indeed in use, the shaft 26 remains stationary relative to the housing 1 and it is the rotor body 9, driven by the motor 5, which moves relative to the housing and hence relative to the body of a person against which the device is placed. The shaft 26 is mounted relative to the housing 1 in a manner to ensure that it remains stationary relative to the housing. Such may for example occur by the location of the stub ends 6, 7 of the shaft 26 which may be of a square or rectangular or other non-circular configuration. The stub ends 6, 7 of the shaft 26 may locate in suitably shaped rebates of the housing and tightly fit therewith, thereby preventing rotation of the shaft 26 relative to the housing 1. The shaft itself may present suitable bearing surfaces such as the surface 21 which for example with reference to FIG. 6A are provided at or towards each distal end of the rotor body 9 for the purposes of allowing a complimentary shaped surface of the rotor body to engage therewith in a manner to be supported on said shaft in a rotational manner. In the most preferred form the bearing of the rotor body 9 with the shaft 26 is preferably a direct journal bearing. With the appropriate selection of materials, sufficient freedom of rotation can be established yet still ensure that a tight fit occurs. For example the shaft 26 may be made from a metallic material and the complimentary shaped bearing surfaces of the rotor body which engage with the surfaces 21 of the shaft may be made from a plastics material. Such may have the characteristics of a Teflon or similar low friction index material. As can be seen with reference to FIG. 6B the first and second ends 30, 31 of the rotor body 9 are provided with such bearing surfaces to be supported by the bearing surfaces 21 of the shaft 26. The bearing surfaces are preferably cylindrical surfaces.

Figure 3B:
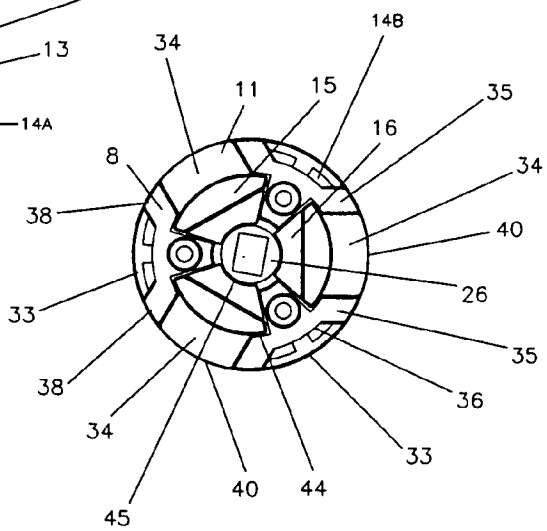
FIG. 3B is an end view in direction BB of FIG. 3A.
Figure 3A:
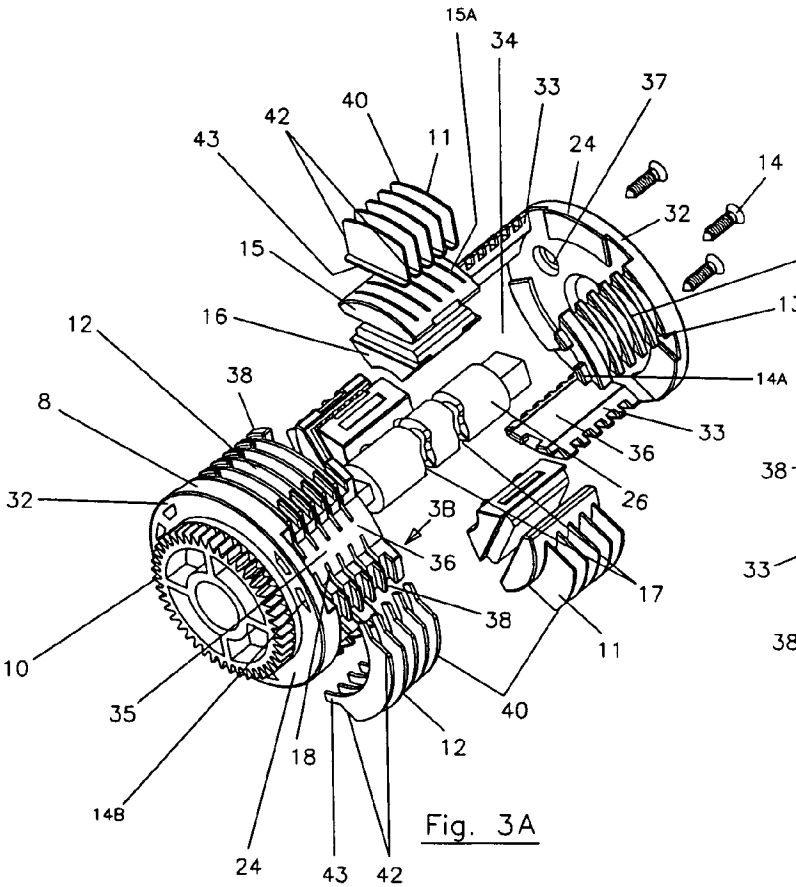
FIG. 3A is an exploded view of the rotary mechanism showing all the internal components.

As has been mentioned, the rotor body 9 itself is an assembly of relative moving components. A first component of the rotor body 9 is the rotational carrier 24. It is the rotational carrier which when the epilating device is in use, moves relative to the shaft 26 in a purely rotational manner. It is the rotational carrier 24 which provides the main bearing surfaces which engage with the surfaces 21 of the shaft 26. The rotational carrier 24 includes two end plates each positioned respectively at the first and second ends 30, 31 of the rotor body 9. The end plates are connected together via longitudinally extending interconnect members 33. The interconnect members 33 may be integrally formed with one or both of the end plates 32 or may be assembled therewith. With reference to FIG. 3A, it can be seen that the interconnect members may be formed integral with one end member 32 and include securing lugs 14A to extend into complimentary shaped apertures 14B of the other of the end plates 32 in order to become engaged together. At least two and preferably three interconnect members 33 are provided each spaced from each other to provide an opening 34 therebetween. Each opening will allow therethrough, the presentation of an epilating zone to which further reference will hereinafter be made.

In the most preferred form the interconnect members 33 are equispaced to provide substantially similar sized openings at the cylindrical perimeter of the rotor body 9. The interconnect members 33 include an external perimeter surface 13 which in part will define the perimeter of the cylindrical rotor assembly 3. The external perimeter surface 13 includes grooves extending in an annular direction with the cylindrical perimeter of the rotor body. A plurality of grooves are spaced longitudinally (in the axial direction AA) along each of the interconnect member 33. The purpose of such grooves is to encourage the hairs to be guided to become positioned between the pairs of clamping blades. The grooves in the circumference will encourage such movement of hair into the clamping zones between the pairs of blades whereupon the closing of the blades, the hairs become captured between the blades. Each interconnect member has the same number of grooves and each are aligned with each other. The grooves are also aligned with the gaps between each plucking blade pair.

The interconnect members 33 are formed with one of the end plates 32 preferably each engage with secondary interconnect members 35 which are preferably formed with the other of the end plates 32. The secondary interconnect members 35 and the interconnect members 33 have snugly fitting complimentary and axially slideable engagement surfaces 36 to allow for an in the axial direction sliding engagement of the two components defining the rotational carrier 24. The secondary interconnect members 35 include fastening regions which are preferably threaded or threadable apertures extending parallel to the axial direction and with which fastening screws 14 passing through the end plate carrying the interconnect members 33 can extend. The end plate 32 carrying the interconnect members 33 are preferably provided with apertures 37 through which the fastening screws 14 can pass to engage with the apertures (not shown) of the secondary interconnect members 35.

The interconnect members 33 and 35 will hold the end plates 32 apart and with the openings 34 between the interconnect members and the spacing of the end plates apart, openings between which the hair clamping mechanism is to be positioned, are provided.

One or both end plates 32 include a means to allow for the transmission of rotational power from the motor to the rotor body 9. With reference to for example FIGS. 2 and 3A, one of the end plates includes a gear 10 provided for such purposes. Preferably the gear 10 is provided at the extreme distal end 31 of the end plate 32. In the most preferred form the end plate 32 with its secondary interconnect members 35 are injection moulded and hence are formed integrally. Alternatively the gear 10 may be assembled with the end plate 32. The gear is coaxial with the axis of rotation AA about which the rotor body 9 is able to rotate. The gear is of a size which with the selection of any intermediate gearing between the motor shaft and the rotor body 9 will allow for the rotor body 9 to rotate at a speed or speeds which are appropriate for the hairs of a body be subjected to a plucking action of the device of the present invention. In such a configuration the end plates 32 extend substantially parallel to each other and extend substantially radially to the axis AA. The secondary interconnect members also include fingers 38 which extend to the cylindrical perimeter 8 of the rotor body 9. Each of the fingers 38 comprises of a plurality of ridges 39 extending annularly and are separated by annular slots which in the most preferred form align with the slots of the external perimeter surface of the interconnect members 33. The purpose for such alignment is to allow for a continuation of the slots in the interconnect members 33 and to thereby allow for the hairs to be guided in between the pair of clamping blades. Should the hairs not be clamped and removed by one array of pair of blades then the grooves may guide such hair in alignment with a subsequent blade as it comes around during the rotation of the rotary cylinder. The fingers 38 of each of the secondary interconnect members 35 flank (in a longitudinal direction), each of the interconnect members 33. It is accordingly intermediate of adjacent fingers 38 of adjacent secondary interconnect members between which the majority of the openings 34 are provided.

Figure 3C:
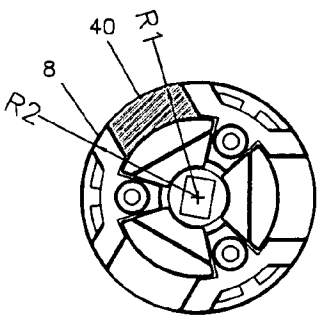
FIG. 3C is the view shown in 3B showing the radii of the cylindrical rotor and the pinching edges.

The epilating action or plucking action generated by the cylindrical rotor assembly of the present invention occurs between a plurality of blade pairs. In the most preferred form the present invention as shown in the accompanying drawings there are three arrays of a plurality of such blade pairs. Each array extends substantially parallel to the longitudinal or axial direction of axis AA. Each array is provided in conjunction with each of the openings 34 provided through the rotational carrier 24. In general, and with reference FIG. 3A, each array may include a plurality of axially spaced apart blade pairs. In the example shown in FIG. 3A five blade pairs per array are shown. Each blade pair includes a moveable blade 11 and a stationary blade 12. The stationary blades are stationary relative to the rotational carrier 24. The moveable blades of each pair move in a direction parallel to the axial direction defined by axis AA. Each blade of each pair are substantially of a planar configuration as for example shown in FIG. 3A. They are preferably made from a metallic material which is of a sufficient thickness to remain stiff or at least resilient to the forces to which they may be subjected. The blades are positioned relative to the rotational carrier to extend in general in a radial direction. They each include perimeter edges 40 which are arcuate and have a radius R1, as shown in FIG. 3C. Radius R1 of perimeter edges 40 is substantially the same as the radius R2 of the cylindrical perimeter 8 of the rotor body 9. The movable and fixed blades 11, 12 of each pair are positioned with their planar surfaces parallel or close to being parallel. The blades of each pair are movable towards and away from each other (the mechanism of which will hereinafter be explained in more detail) such that at least some of the respective perimeter edges 40 of the blades of each pair move to engage with each other and disengage with each other. This movement is predominantly linear. Such movement may further result in an engagement of the facing planar surfaces of the blades of each pair but in the most preferred form initial contact in the movement of the blades of each pair together, occurs at least in part and preferably across the entire perimeter edges 40 or pinching edges of the blades of each pair. With hairs positioned intermediate of the blades of each pair when such are in engagement with each other, will subject the hairs to a pinching action sufficient such that movement of the blades relative to the skin of the user will in general pull the hairs sufficiently to remove such from the person.

In order to ensure that a pinching of hairs by and between the blade pairs of the present invention occurs in a manner which is going to effectively hold the hairs so that they can be pulled from the skin of a person, the blades of each pair are preferably at a slight angle relative to each other. Such will also ensure that the strongest point of gripping between the blades of each pair, of hairs occurs as close as possible to the skin of the person. This is as a result of the angling of the blades of each pair relative to each other so as to place the perimeter edges 40 most proximate with each other. Accordingly upon movement of the blades of each pair to a condition where such will pinch hairs therebetween, the perimeter edges 40 of the blades of each pair will make first contact with each. With reference to FIG. 6C, it is preferably the movable blades 11 are disposed at an angle 25 relative to the radial direction extending from the axis AA. Thus, the pinching edges of the movable blades 11 are positioned more proximate to the pinching edges of the stationary blades 12 relative to the planar surfaces of the same blades. Therefore, as shown in FIG. 6C. the distance M, i.e., the distance between the pinching edges 40 of the movable blade 11 and the stationary blade 12, is smaller than the distance N, i.e., the distance between the planar surfaces of the movable blade 11 and the stationary blade 12. However it may alternatively or in addition be the fixed blades 12 which are disposed at an angle to such a radial direction. In the movement of a blade pair from an opened condition as for example shown in FIG. 6A to a closed condition as for example shown in FIG. 6B the blades of each pair move substantially in a direction parallel with the axis AA. When in a closed condition as shown in FIG. 6B the blades of each pair are in engagement with each other thereby pinching any hairs which may be positioned and captured between the blades of each pair. When in an opened condition hairs can move freely between the space defined between the blades of each pair of blade pairs 41. Since the blades of each blade pair have a perimeter edge 40 which is substantially of the same diameter, and because of the angular positioning of the planes of the blades relative to each other for the purpose as above described, contact of the blades of each pair occurs initially at a single point of contact. Since the blade of each pair are in substantial axial alignment with each other such point of contact is midway between the distal edges 42 of the blades. However since the blades are made preferably a resiliently flexible metallic material, further movement of the blades of each pair towards each other will flex the blades such that at least the entire perimeter edge 40 commensurate with the cylindrical perimeter 8 of the rotor body, come into engagement with each other. With reference to FIG. 6B, even further advancement of the blades in the axial directions towards each other may cause for the blades to flex sufficiently for the facing surfaces of the blades of each pair to become engaged against each other. Because of the initial angular disposition between the blades of each pair, the most significant clamping force will remain at the perimeter edges 40 of the blades of each pair despite the facing surfaces of the blades of each pair being in full engagement with each other as for example shown in FIG. 6B.

The fixed blades 12 of an array are positioned each to one side (in the longitudinal direction) to the movable blades. The movable blades of each array are movable in unison relative to the respective fixed blades. The fixed blades remain stationary relative to the rotational carrier 24 whilst the movable blades 11 oscillate in the longitudinal direction relative to the fixed blades. All blade pairs of an array are accordingly in the same condition at any given moment. The fixed blades 12 are fixed relative to the rotational carrier 24. In the most preferred form the fixed blades are engaged within slots of a complimentary width to the thickness of the fixed blades 12 provided by the secondary interconnect members 35. Such slots 18 place each of the fixed blades in a spaced part condition in the axial direction sufficient to allow for the fixed blades of each blade pair to extend through such a gap between the fixed blades 12. The fixed blades 12 and the slots 18 are of a configuration such that the fixed blades 12 are securely affixed with the rotational carrier 24 when the rotor body is fully assembled. The fixed blades 12 may include securing tabs 43 which may locate within an undercut of the secondary interconnect members to prevent the fixed blades from moving radially outwardly relative to the rotational carrier 24. The slots 18 are preferably of a depth (in the radial direction) sufficient to allow for the fixed blades to be held in a radially extending direction and sufficiently rigidly relative to the rotational carrier such that when a clamping of hairs intermediate of the fixed blade and movable blade pairs occurs the fixed blades 12 are sufficiently resilient to displacement to allow for a sufficient force of clamping to be subjected to the hairs. The portions of the fixed blades extending into the slot are correspondingly also of a sufficient radial extension to ensure such clamping forces can be generated as a result of a sufficiently rigid mounting of the fixed blades with the rotational carrier 24. The mounting of the fixed blades with the rotational carrier is such that for each array of blades the blades in the axial direction are substantially aligned with each other.

Figure 5A:
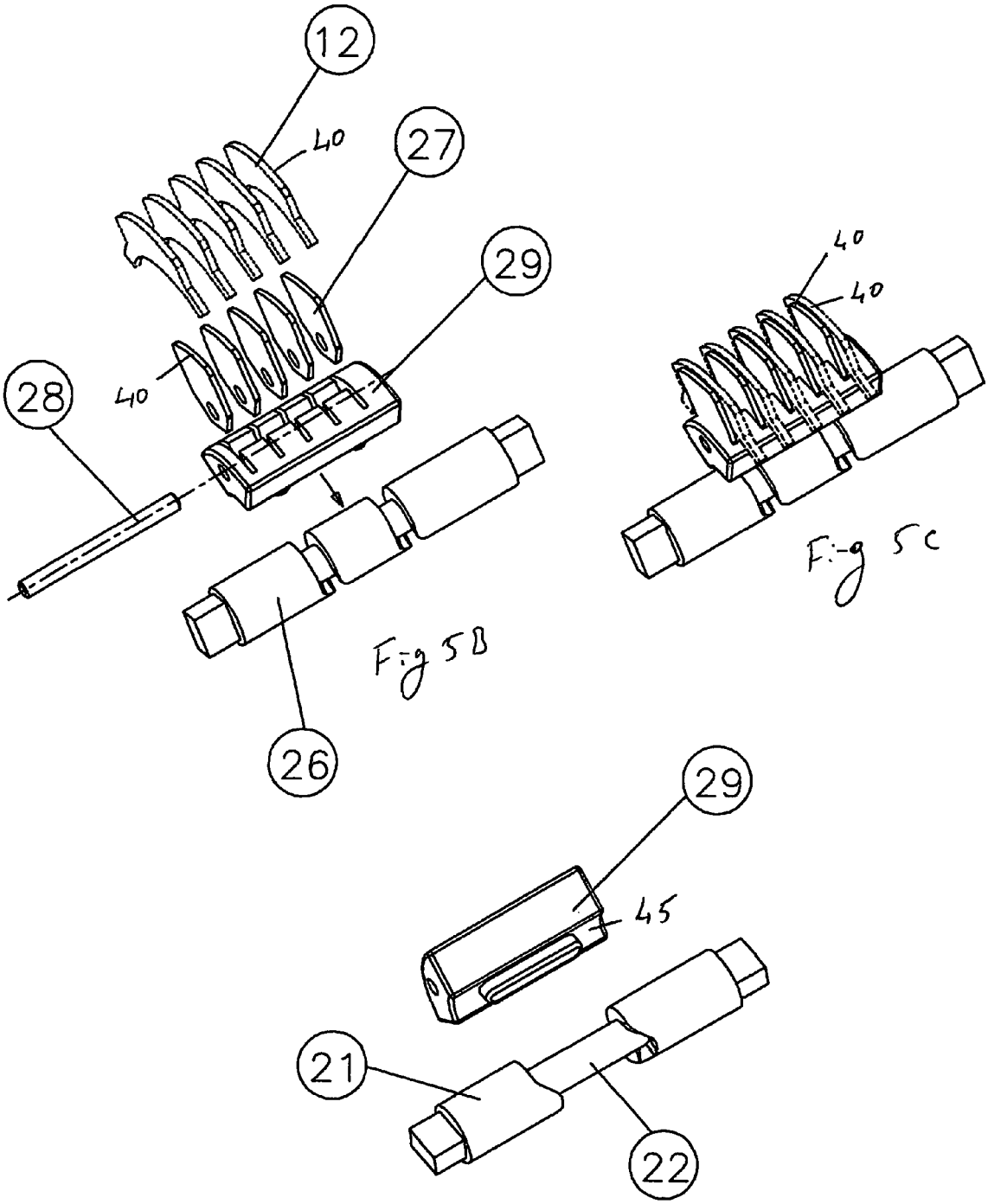
FIG. 5A is a perspective view showing an alternative construction of the shuttle member in relation with the shaft.

The movable blades of each array are disposed toward the same side of each of their respective fixed blades. The movable blades of each array are carried by a single shuttle 15. The shuttle 15 moves all of the movable blades 11 of one array simultaneously. The shuttle 15 moves such movable blades in an oscillating matter and in a direction parallel to the axis of rotation AA between the open and closed conditions as shown in FIGS. 6A and 6B respectively. The shuttle carries a plurality of movable blades 11 in an array which is substantially aligned in the axial direction. Each of the movable blades of each array are spaced apart a distance equal to the spacing of that of the fixed blades with which the movable blades are to engage with. The shuttle itself may be an assembly of a holder which includes slots 15A through which the movable blades can extend. The slots are of a size to allow for the movable blades to extend therethrough and are of a radial depth sufficient to allow for sufficient rigidity to be provided to the movable blades. The movable blades may include a base flange 43 as shown in FIGS. 3A and 6C for the purposes of ensuring that the movable blades remain affixed with the respective shuttle 15 and are thereby prevented from moving radially outwardly to become dislodged from the respective shuttle. The shuttle further includes a base member 16 which can engage with the holder of the shuttle and thereby capture the base flange 43 with the shuttle to prevent the movable blades from moving radially inwardly relative to the shuttle. Each shuttle of each array remains engaged with the rotational carrier 24 as a result of mating surfaces 44 presented substantially tangentially to the rotational axis and which captures the shuttle 15 in a radial direction relative to the rotational carrier 24. The mating surfaces 44 prevent the shuttle from moving in a radial direction relative to the rotational carrier and ensures that the movable blades are only movable relative to the rotational carrier and to the fixed blade in a direction parallel to the axial direction. The mating surfaces 44 are hence parallel to the axial direction AA. The mating surfaces 44 capture the shuttle within the rotational carrier 24. With reference to FIG. 5B an alternative assembly of a shuttle carrying movable blades is shown. In this configuration each of the movable blades is locatable within slots of the shuttle 29. Each of the blades 27 includes an aperture therethrough which when the blades are positioned in the slots are in full alignment to thereby allow for a pin 28 to extend therethrough and through apertures at the ends of the shuttle 29 to secure the blades with the shuttle.

The shuttle is of a length in the axial direction smaller than the distance between the facing surfaces of the end plates 32. As can be seen with reference to FIG. 6A a space 20 between the shuttle 15 and the rotational carrier is provided in the axial direction which is sufficient to provide clearance to allow for the shuttle 15 to move in the axial direction to displace the movable blades 11 relative to the fixed blades 12 in such an axial direction. Each of the shuttles 15 is prevented from moving radially inwardly by capturing surfaces between the shuttle and either the rotational carrier 24 and/or the shaft 26. In the most preferred form a radially inwardly directed surface 45 of the shuttle is provided for engagement against the bearing surface 21 of the shaft 26. Such is for example shown in FIGS. 4A, 4B and 5A. Accordingly the shuttle is captured between the bearing surface 21 of the shaft 26 (preventing its movement radially inwardly) and by the mating surfaces 44 between the rotational carrier 24 and the shuttle 15. The relationship between the radially inwardly directed surface 45 and the bearing surface 21 is such as to allow for freedom of movement of the shuttle in the axial direction.

Figure 4B:
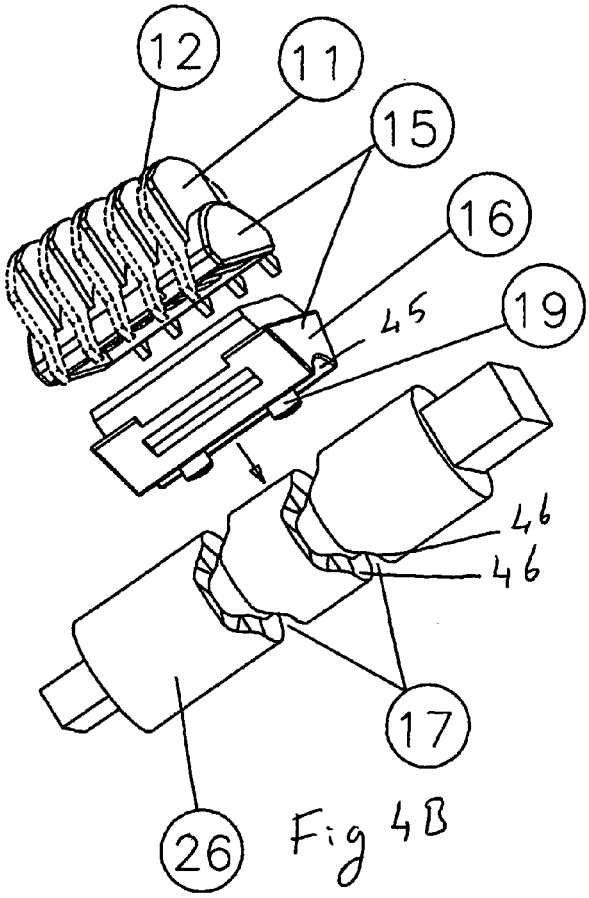
FIG. 4B is a perspective and exploded view of an alternative construction of the arrangement of FIG. 3A.
Figure 4C:
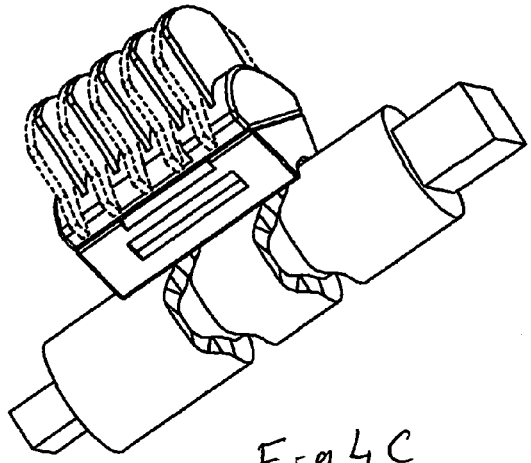
FIG. 4C is an assembled view of the components of FIG. 4B.
Figure 4A:
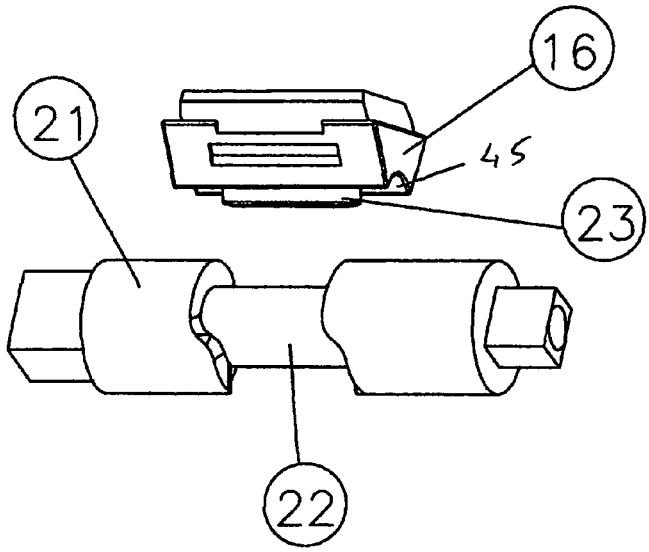
FIG. 4A is a perspective view showing details of the shuttle member and in relation with the shaft.
Figure 7:
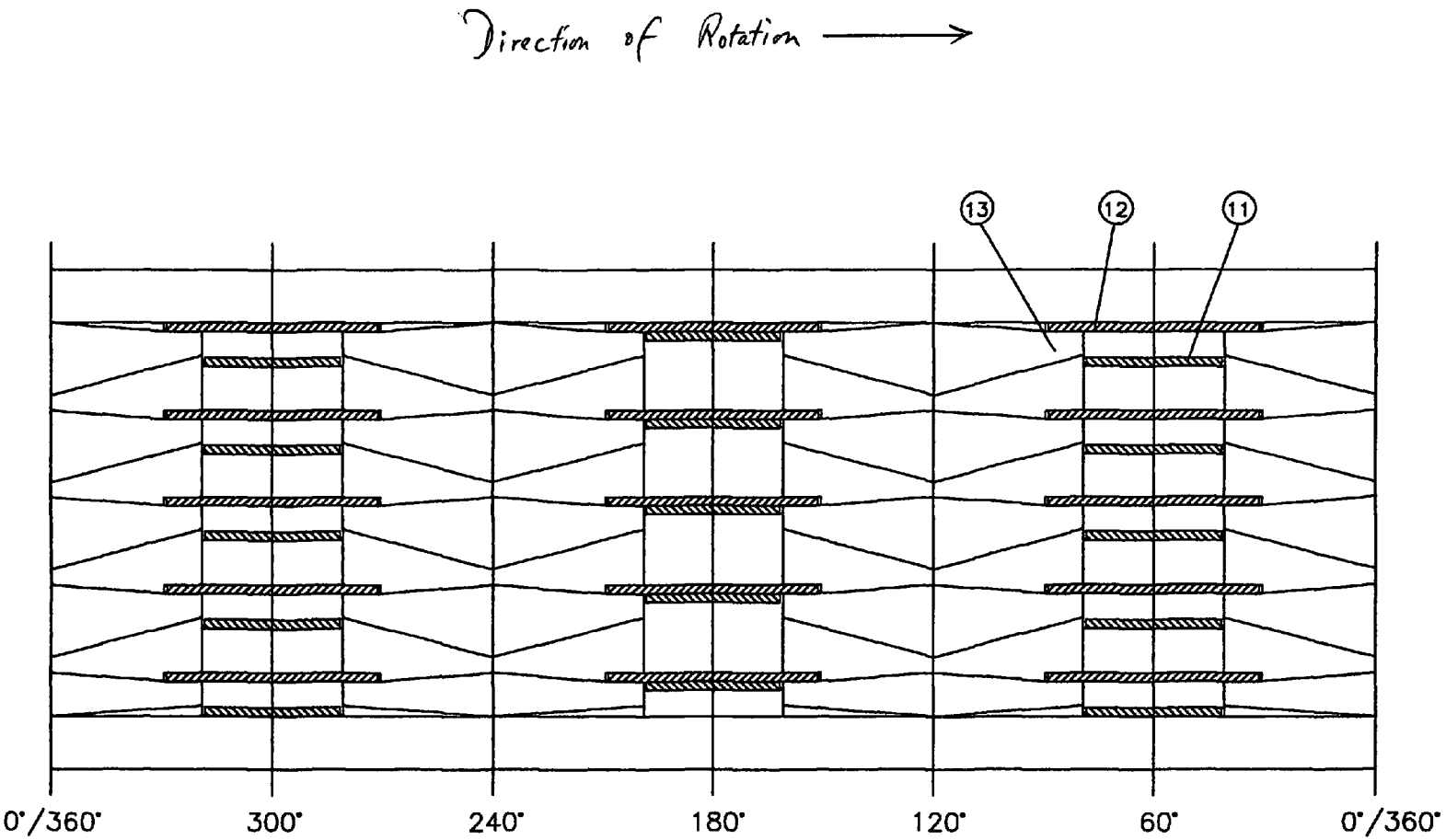
FIG. 7 is a developed view of a shell surface of the rotary mechanism showing the relative position of the clamping blades at different angles of the rotary mechanism.

Positioning of the shuttle and hence the movable blades in the axial direction is controlled by a camming relationship of the shuttle 15 and the shaft 26. The shuttle 15 with the rotational carrier 24 are rotatable about the fixed shaft 26. Mutually engageable camming surfaces 22 and 23 as shown in FIG. 4A or 17 and 19 and shown in FIG. 4B allow for the displacement of the shuttle in the axial direction to be positively controlled as a result of relative rotation of the shuttle about the shaft 26. In the most preferred form as shown in FIG. 4B two cooperative camming provisions are provided. Each camming provision preferably includes slot 17 within which a pin 19 projecting from the radially inwardly directed surface 45 of the shuttle can locate. The slot includes axially separated surfaces 46 which are of a profile varying in displacement in the axial direction. With reference to FIG. 4B, the left more surface 46 controls the movement of the shuttle in a direction travelling towards the right hand side whereas the right surface 46 controls the return movement of the shuttle towards the left hand side. The slot 17 is preferably of a width slightly larger than the width (in the axial direction) of the pin 19. The slot or track 17 controls the movement of the shuttle in both directions as a result of relative rotation of the shuttle and the shaft. With reference to FIG. 7 a developed plot of the relative positioning of the fixed and movable blades of each of the three arrays is shown over a complete 360 degree rotation of the rotor body about the shaft 26.

The profile of the surfaces 46 is such as to allow for such displacement during the relative rotation of the rotor body about the shaft 26 to occur. In particular it can be seen that at 180 degrees the movable blades are in an engaged condition with the fixed blades thereby being able to clamp hairs between the pairs of blades. Upon the clamping of hairs between the blades, and further subsequent rotation of the blades about the axis during which the blades remain in a clamping or pinching condition, the hairs are subjected to movement relative to the skin of the person and as a result are plucked from the skin of the person. The blades remain in a clamping condition over a sufficiently long arc of rotation for such a plucking action to occur. It can be seen that during one entire revolution, the blades of each pair come into a clamping arrangement preferably only once. Prior to and subsequent to being presented to the opening the blades of each pair are in an opened condition. Whilst the shaft may be made of a metallic material or of a plastic and metallic combination. Likewise the rotor may be made from a metallic material and a plastic combination. Indeed and with reference to FIG. 5A, the bearing surface defining portions 21 may be made from a plastics material and the section 22 including the stub ends 6 and 7 may be made from a metallic material. Such would reduce the complication of machining of the shaft to define the camming surface.

The invention claimed is:

1. A cylindrical rotor for an epilating device which includes a support body containing an electrical motor which in use provides a rotational drive to said cylindrical rotor, said cylindrical rotor including:

a rotor body;

a shaft extending through said rotor body and defining an axis of rotation about which said rotor body can rotate, said shaft comprising a cam surface configured as an annular slot within said shaft; and at least one array of radially extending blade pairs positioned to present mutually interacting pinching edges of each said blade pair at a circumference of the cylindrical rotor, each blade pair including a rotor body stationary blade and a blade movable relative to said stationary blade, wherein each of said movable blades of said at least one array is mounted on a shuttle carried by said rotor body, said shuttle being in a cammed disposition with said shaft and said cammed disposition being of a kind wherein cooperative surfaces of said shaft and said shuttle, upon a relative rotation of said shaft with said rotor body and said shuttle carried with said rotor body, moves said shuttle in an oscillating manner in a direction parallel to the axis of rotation of said rotor body, in a manner to repeatedly bring said movable and stationary blades of each blade pair into and subsequently out of mutual engagement at least at the circumference of said cylindrical rotor to entrap and subsequently release hairs there between, and wherein said shuttle includes a cam follower upstand snugly located within said annular slot and projecting for engagement with said cam surface of said shaft to positively control the positioning of said shuttle in its reciprocating movement relative to said rotor body.

2. A cylindrical rotor as claimed in claim 1 wherein said blades of each blade pair are non parallel to each other in a manner to place the pinching edges of the blades of each blade pair at said circumference more proximate to each other.

3. A cylindrical rotor as claimed in claim 1 wherein said blades of each blade pair include planar facing regions extending radially inwardly from said pinching edges.

4. A cylindrical rotor as claimed in claim 3 wherein for each blade pair, said pinching edges of the stationary blade and the movable blade are more proximate to each other than the planar facing regions of said blades at least when said planar facing regions are inclined to each other.

5. A cylindrical rotor as claimed in claim 3 wherein the planar facing region of one of said movable and stationary blade of each blade pair is inclined to the radial plane of said cylindrical rotor, and wherein the planar facing region of the other blade of each blade pair is parallel to the radial plane of said cylindrical rotor.

6. A cylindrical rotor as claimed in claim 3 wherein said blades are made from a resiliently flexible sheet metal, wherein the blades of each pair, when in mutual engagement with each other are in pinching edge to pinching edge contact and in at least part planar facing region to planar facing region contact.

7. A cylindrical rotor as claimed in claim 1 wherein said pinching edges are arcuate edges with a radius substantially similar to the cylindrical rotor.

8. A cylindrical rotor as claimed in claim 1 wherein one of said movable and stationary blades of each blade pair is inclined to the radial plane of said cylindrical rotor, the other of each blade pair is parallel to the radial plane of said cylindrical rotor.

9. A cylindrical rotor as claimed in claim 1 wherein each said movable blade is movably positioned relative to its respective stationary blade of said blade pair so that upon the rotation of said rotor body relative to said shaft, said blades of each said blade pair move into and subsequently out of relative engagement with each other, at least at the circumference of said cylindrical rotor.

10. A cylindrical rotor as claimed in claim 1 wherein said array includes at least two blade pairs.

11. A cylindrical rotor as claimed in claim 1 wherein said array includes at least three blade pairs.

12. A cylindrical rotor as claimed in claim 1 wherein said array includes at least five blade pairs.

13. A cylindrical rotor as claimed in claim 1 wherein at least two arrays of blade pairs are provided, each array being separated from the adjacent array and being equidistant from each other at least on the circumference of said cylindrical rotor.

14. A cylindrical rotor as claimed in claim 13 wherein the plurality of said stationary blades of a first array are in annular alignment with corresponding stationary blades of the other array(s) of blades.

15. A cylindrical rotor as claimed in claim 13 wherein a said shuttle for each array is provided to move independently of said other shuttles.

16. A cylindrical rotor as claimed in claim 1 wherein three arrays of said blade pairs are provided, said arrays being equidistant from each other on the circumference of said cylindrical rotor.

17. A cylindrical rotor as claimed in claim 1 wherein said rotor body defines a cavity within which said shuttle is engaged and captured and in a manner to allow said shuttle so oscillate in an axial direction relative to the rotor body yet remain stationary in said rotational direction relative to said rotor body.

18. A cylindrical rotor as claimed in claim 17 wherein said cavity includes at least one opening to the perimeter of said rotor body at which said pinching edges of said blade pairs of an array of blades is disposed.

19. A cylindrical rotor as claimed in claim 18 wherein said rotor body includes a perimeter surface intermediate said at least one opening, said perimeter surface in part defining the cylindrical perimeter of said cylindrical rotor.

20. A cylindrical rotor as claimed in claim 19 wherein said perimeter surface intermediate of said at least one opening includes annularly extending grooves.

21. A cylindrical rotor as claimed in claim 19 wherein said perimeter surface intermediate of said at least one opening includes annularly extending grooves, axially spaced from each other and annularly aligned with each of said pair of blades of said array.

22. A cylindrical rotor as claimed in claim 19 wherein said perimeter surface intermediate of said at least one opening includes annularly extending grooves, axially spaced from each other and annularly aligned with the space between each of said pair of blades when in said non engaged condition, in order to encourage the alignment of hair with which said perimeter surface is in contact with to align for capturing between a blade pair.

23. A cylindrical rotor as claimed in claim 1 wherein said shaft includes at least two annular slots and wherein said shuttle includes at least two axially spaced upstands, each located within a respective annular slot of said shaft.

24. A cylindrical rotor as claimed in claim 1 wherein a camming relationship between said shuttle and said shaft moves said shuttle from a predominant axial position to an intermittent axial position, said predominant axial position corresponding to placing of each blade pair in a non engaged condition and said intermittent axial position corresponding to an engaged condition.

25. A cylindrical rotor as claimed in claim 1 wherein said shaft extends longitudinally from at least one end of said rotor and wherein said shaft includes stub ends to capture said shaft within said support body and to lock said shaft from rotating with respect to said support body.

26. An epilating device comprising a housing containing a motor which rotationally drives a cylindrical rotor mounted to said housing, said cylindrical rotor partly exposing part of its perimeter through an opening of said housing, said cylindrical rotor further including i. a rotor body;

ii. a shaft extending through said rotor body and defining an axis of rotation about which said rotor body can rotate, said shaft remaining stationary to said housing, said shaft comprising a cam surface configured as an annular slot within said shaft; and iii. at least one array of radially extending blade pairs positioned to present mutually interacting pinching edges of each said blade pair at the circumference of the cylindrical rotor, each blade pair including a rotor body stationary blade and a blade movable relative to said stationary blade wherein each of said movable blades of said at least one array is mounted on a shuttle carried by said rotor body, said shuttle being in a cammed disposition with said shaft, wherein in said cammed disposition cooperative surfaces of said shaft and said shuttle, upon the relative rotation of said rotor body and said shuttle carried with said rotor body about said shaft, moves said shuttle in an oscillating manner in the directions parallel to the axis of rotation of said rotor body, in a manner to repeatedly bring each said blade pair into and subsequently out of mutual engagement at least at the circumference of said cylindrical rotor to entrap and subsequently release hairs there between, said movement between said blade pairs being coincident with the passing of said blade pairs through said opening of said housing; and wherein said shuttle includes a cam follower upstand snugly located within said annular slot and projecting for engagement with said cam surface of said shaft to positively control the positioning of said shuttle in its reciprocating movement relative to said rotor body.

27. An epilating device as claimed in claim 26 wherein said rotor body is mounted to said housing by said shaft.

* * * * *